US011342693B2

(12) United States Patent
Arai et al.

(10) Patent No.: US 11,342,693 B2
(45) **Date of Patent: *May 24, 2022**

(54) CONNECTOR ASSEMBLY

(71) Applicant: Molex, LLC, Lisle, IL (US)

(72) Inventors: Masayuki Arai, Yamato (JP); Shigeru Akiyama, Yamato (JP); Qiucen He, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/062,642

(22) Filed: Oct. 5, 2020

(65) Prior Publication Data

US 2021/0021064 A1 Jan. 21, 2021

Related U.S. Application Data

(63) Continuation of application No. 16/535,077, filed on Aug. 8, 2019, now Pat. No. 10,840,618.

(30) Foreign Application Priority Data

Oct. 5, 2018 (JP) ..... JP2018-190430

(51) Int. Cl.
*H01R 12/58* (2011.01)

(52) U.S. Cl.
CPC ..... *H01R 12/58* (2013.01)

(58) Field of Classification Search
CPC ..... H01R 12/587; H01R 12/55; H01R 12/53; H01R 12/52; H01R 12/51; H01R 12/50; H01R 12/00
USPC ..... 439/79, 82, 629, 630, 59, 60, 61, 62
See application file for complete search history.

(56) References Cited

U.S. PATENT DOCUMENTS

| | | | | |
|---|---|---|---|---|
| 3,497,850 | A | 2/1970 | Gallo, Sr. | |
| 5,083,944 | A | 1/1992 | Pitts | |
| 5,899,764 | A | 5/1999 | Harting et al. | |
| 6,506,081 | B2 | 1/2003 | Blanchfield et al. | |
| 6,869,294 | B2 | 3/2005 | Clark et al. | |
| 7,422,451 | B2 | 9/2008 | Chen et al. | |
| 7,524,209 | B2 * | 4/2009 | Hull | H01R 13/514 439/607.01 |
| 7,802,994 | B1 * | 9/2010 | Chen | H01R 12/732 439/65 |
| 7,963,810 | B1 | 6/2011 | Yang | |

(Continued)

FOREIGN PATENT DOCUMENTS

| | | | |
|---|---|---|---|
| CN | 1538571 | A | 10/2004 |
| CN | 2699510 | Y | 5/2005 |

(Continued)

OTHER PUBLICATIONS

Decision to Grant received for Japanese Patent Application No. 2018-190430, dated Feb. 8, 2022, pp. 5 (2 pages of English translation and 3 pages of official notification).

*Primary Examiner* — Harshad C Patel

(57) ABSTRACT

A terminal retention hole of a receptacle housing has guide grooves for permitting sliding of protruding guide parts of a receptacle terminal in the engaging longitudinal direction of the protruding guide parts. Each of the plug terminals has a base part and a contact part extending from the base part. A thickness of the plug terminal contact part in the horizontal direction is smaller than the thickness of the plug terminal base part in the horizontal direction.

12 Claims, 12 Drawing Sheets

(56) References Cited

U.S. PATENT DOCUMENTS

| | | | | |
|---|---|---|---|---|
| 8,262,395 | B2 | 9/2012 | Ke et al. | |
| 9,105,997 | B2 | 8/2015 | Ohkuma | |
| 9,711,897 | B2 | 7/2017 | Ho | |
| 9,979,125 | B2 | 5/2018 | Hamada et al. | |
| 10,096,916 | B2 | 10/2018 | Yoshida | |
| 10,381,775 | B2 | 8/2019 | Zheng et al. | |
| 10,840,618 | B2 * | 11/2020 | Arai | H01R 12/58 |

FOREIGN PATENT DOCUMENTS

| | | | |
|---|---|---|---|
| CN | 1770562 | A | 5/2006 |
| CN | 2793959 | Y | 7/2006 |
| CN | 202167647 | U | 3/2012 |
| CN | 202205949 | U | 4/2012 |
| CN | 202373763 | U | 8/2012 |
| CN | 202712502 | U | 1/2013 |
| CN | 202749598 | U | 2/2013 |
| CN | 203589290 | U | 5/2014 |
| CN | 204992055 | U | 1/2016 |
| CN | 204992072 | U | 1/2016 |
| CN | 206490200 | U | 9/2017 |
| CN | 207320401 | U | 5/2018 |
| CN | 108574164 | A | 9/2018 |
| JP | S63-50781 | Y2 | 12/1988 |
| JP | H04206181 | A | 7/1992 |
| JP | H0722106 | A | 1/1995 |
| JP | 2005158730 | A | 6/2005 |
| JP | 2012-129082 | A | 7/2012 |
| JP | 2014130693 | A | 7/2014 |
| KR | 20160076334 | A | 6/2016 |
| TW | 201308787 | A | 2/2013 |
| WO | 2005031922 | A2 | 4/2005 |

* cited by examiner

CONNECTOR ASSEMBLY

RELATED APPLICATIONS

This application is a continuation of U.S. application Ser. No. 16/535,077, filed on Aug. 8, 2019, which claims priority to Japanese Application No. 2018-190430, filed on Oct. 5, 2018. Each of the foregoing applications are incorporated herein by reference in their entireties.

TECHNICAL FIELD

The present disclosure relates to a connector assembly.

BACKGROUND ART

As exemplified in patent document 1 described below, connectors have been used to date to connected a plurality of cables on a circuit board. One of the connectors has terminals provided on each of the ends of a plurality of cables lined up in the horizontal direction (this connector is called a "receptacle connector" and these terminals are called "receptacle terminals"). Each of the receptacle terminals has a pair of opposing contact parts formed in a plate spring shape. The other end of the connector includes a plurality of terminals soldered to the circuit board (here, this connector is called a "plug connector" and this terminal is called a "plug terminal") A plug terminal is inserted between a pair of contacts of a receptacle terminal.

Patent Document 1: Japanese Unexamined Patent Application 2012-129082

SUMMARY

A receptacle terminal is inserted in a receptacle connector housing that has a through hole for retention (terminal retention hole). When manufacturing a receptacle connector, there are cases where a worker inserts a receptacle terminal into the housing terminal retention hole incorrectly with the receptacle terminal upside down. Incorrect orientation of the receptacle terminal could cause non-conformances such as the receptacle terminal not reaching the appropriate position in the terminal retention hole. Therefore, the receptacle connector preferably is provided with a structure preventing insertion at such an incorrect orientation.

On the other hand, the terminal is preferably thick to ensure electrical conductivity through the terminal. However, depending on the structure for preventing insertion of a receptacle terminal at incorrect orientation, the plug terminal may become thin, leading to worsening of electrical conductivity. Such is in particular not preferable for high current flow connectors.

An objective of the present disclosure is to propose a connector assembly that prevents insertion of a receptacle terminal at an incorrect orientation, and moreover, reduces worsening of electrical conductivity.

The connector assembly proposed in the present disclosure includes a receptacle connector with a plurality of receptacle terminals lined up in a first direction and a receptacle housing with a plurality of terminal retention holes for retaining the plurality of receptacle terminals; a plug housing with a plurality of plug terminals lined up in the first direction and a plurality of terminal retention holes for retaining the plurality of plug terminals; and a plug connector that can engage with the receptacle connector in a second direction orthogonal to the first direction. The plurality of receptacle terminals respectively have protruding guide parts protruding in the first direction. Each of the plurality of terminal retention holes in the receptacle housing have guide grooves on an inner surface thereof permitting sliding of the protruding guide parts in the second direction for engaging of the protruding guide parts. Each of the plurality of plug terminals have a base part and a contact part extending from the base part in contact with the receptacle terminals when engaged with the receptacle connector. A thickness of the contact part of the plug terminal in the first direction is smaller than a thickness of the base part of the plug in the first direction.

DETAILED DESCRIPTION OF THE PREFERRED EMBODIMENTS

Figure 1:
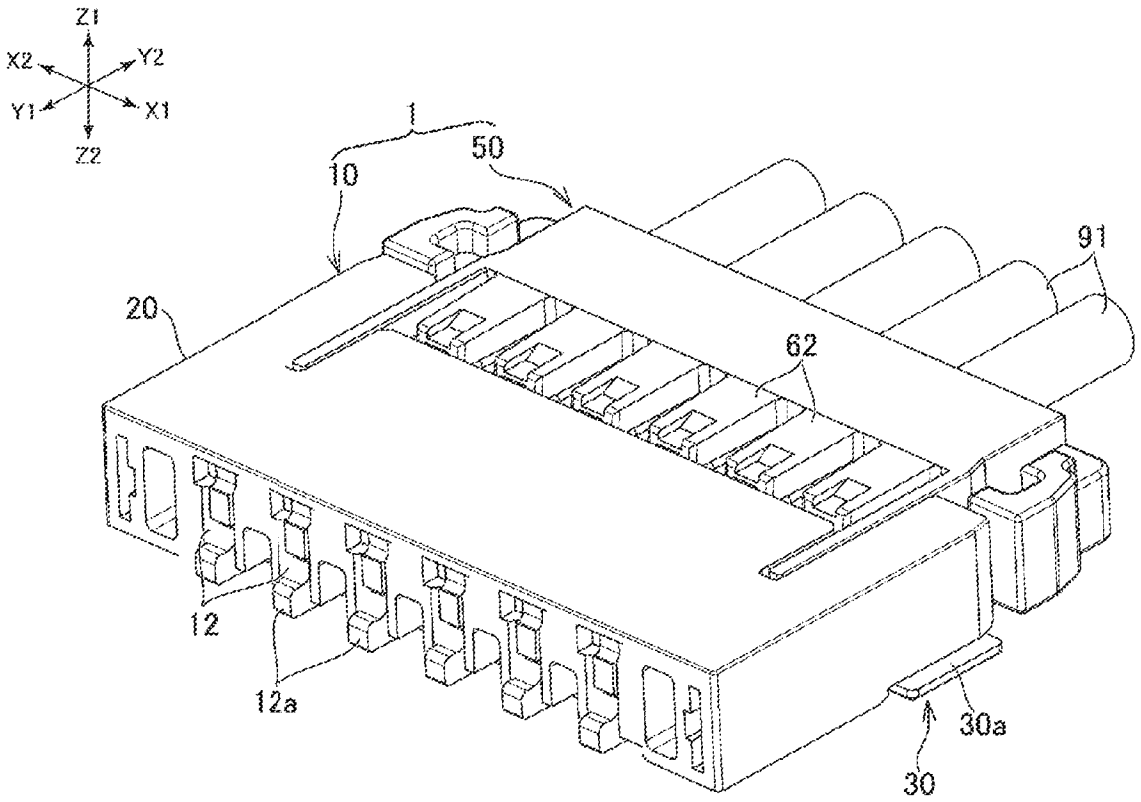
FIG. 1 is a perspective view illustrating an exemplar connector assembly proposed by the present disclosure.

The connector assembly proposed in the present disclosure is described below. The present specification describes the connector assembly 1 shown in FIG. 1 and the like as an example of a connector assembly. In the following description, the directions indicated by X1 and X2 of FIG. 1 are respectively referred to as the right and the left, while the directions indicated by Y1 and Y2 of FIG. 1 are respectively referred to as forward and backward. Moreover, the directions indicated by Z1 and Z2 are respectively referred to as up and down. While these directions are used to describe the relative positional relationships of parts, members, and sections that make up a connector assembly, they do not limit the orientation of the connector assembly 1 during use.

Figure 2:
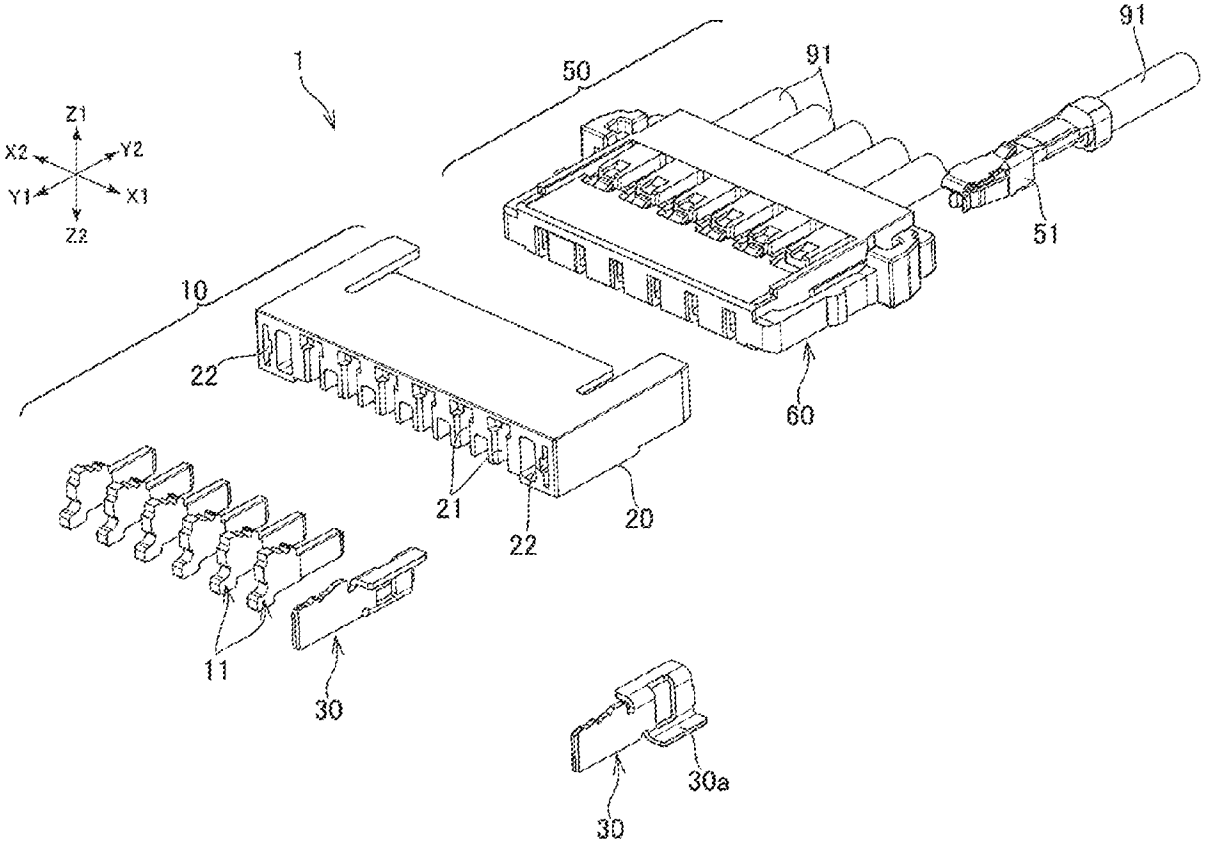
FIG. 2 is an exploded perspective view of the connector assembly.
Figure 3:
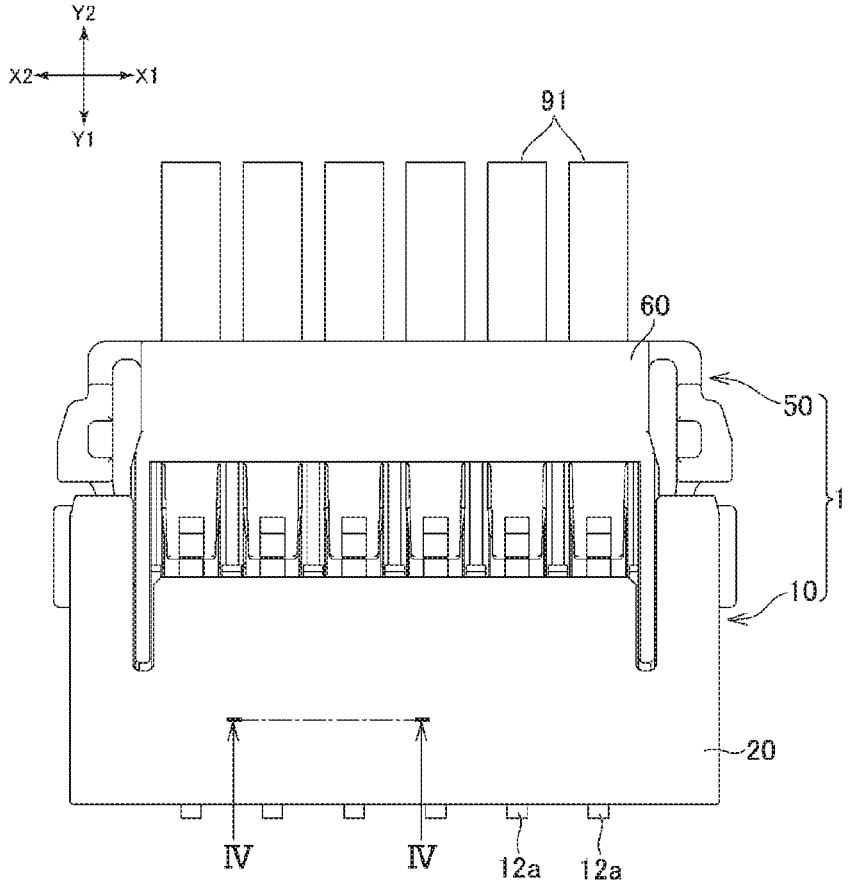
FIG. 3 is a plan view of the connector assembly.

As shown in FIG. 2, the connector assembly 1 has a plug connector 10 and a receptacle connector 50. In the description of the present specification, the two connectors 10 and 50 can be engaged in the forward and backward direction. The connector assembly 1 is a connector assembly for electrically connecting a circuit board and harness (plurality of electrical cables 91). The plug connector 10 can be mounted on the circuit board and the receptacle connector 50 can be attached to the end of the plurality of electrical cables 91. Note, the structure proposed in the present disclosure can be applied to other types of connector assemblies, for example, a connector assembly that connects two harnesses or a connector assembly that connects two circuit boards.

As shown in FIG. 2, the plug connector 10 has a plurality of plug terminals 11 lined up horizontally and a plug housing 20 for retaining the plug terminals 11. The plug housing 20 is formed out of an insulating material (for example, plastic). A plurality of terminal retention holes 21 can be formed lined up horizontally in the plug housing 20. The plurality of plug terminals 11 are respectively inserted and retained in the plurality of terminal retention holes 21. The plug terminals 11 are, for example, inserted from the front towards the back of the plug connector 10 into the terminal retention holes 21. The plug terminals 11 can be provided with a mounting part 12*a* on the front end of the base part 12 (see FIG. 8A and FIG. 8B) for attaching to an electrically conductive pad on a circuit board that the plug connector 10 is mounted on. The plug terminals 11 are, for example, formed out of metal plate. In other words, the plug terminals 11 can be formed by performing a punching process on a metal plate. The plug terminals 11 will be described below.

As shown in FIG. 2, the plug connector 10 can have a reinforcement fixture 30. The reinforcement fixture 30 can be mounted on the right or left of the plug housing 20. The reinforcement fixture 30 has a mounting part 30*a* for soldering onto a circuit board. Thus, mounting of the reinforcement fixture 30 onto the circuit board enables increasing the mounting strength of the plug connector 10 to the circuit board. The reinforcement fixture 30 is, for example, inserted from the front of the plug housing 20 into a retaining hole 22 formed in the plug housing 20.

As shown in FIG. 2, the plug connector 50 has a plurality of plug terminals 51 lined up horizontally and a plug housing 60 for retaining the plug terminals 51. The receptacle housing 60 is formed out of an insulating material (for example, plastic). A plurality of terminal retention holes 61 can be formed lined up horizontally in the receptacle housing 60. The plurality of receptacle terminals 51 are respectively inserted into and retained in the plurality of terminal retention holes 61 (see FIG. 4). The receptacle terminals 51 can be, for example, inserted from the back towards the front of the receptacle housing 60 into the terminal retention holes 61. The receptacle terminals 51 are respectively secured to the end of the plurality of electrical cables 91. The receptacle terminals 51 are, for example, formed out of metal plate. In other words, the receptacle terminals 51 can be formed by performing punching processes and bending processes on a metal plate.

Figure 7A:
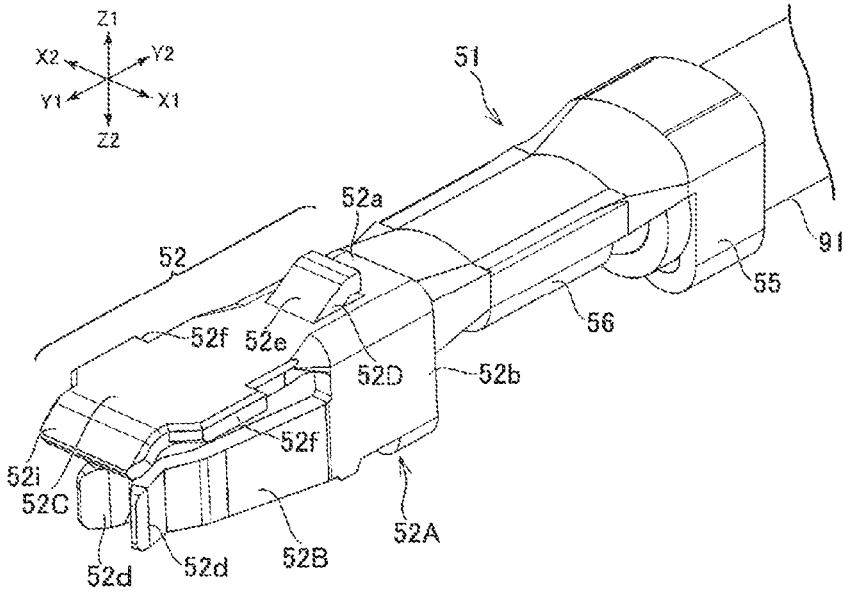
FIG. 7A is a perspective drawing of the receptacle terminal.
Figure 7B:
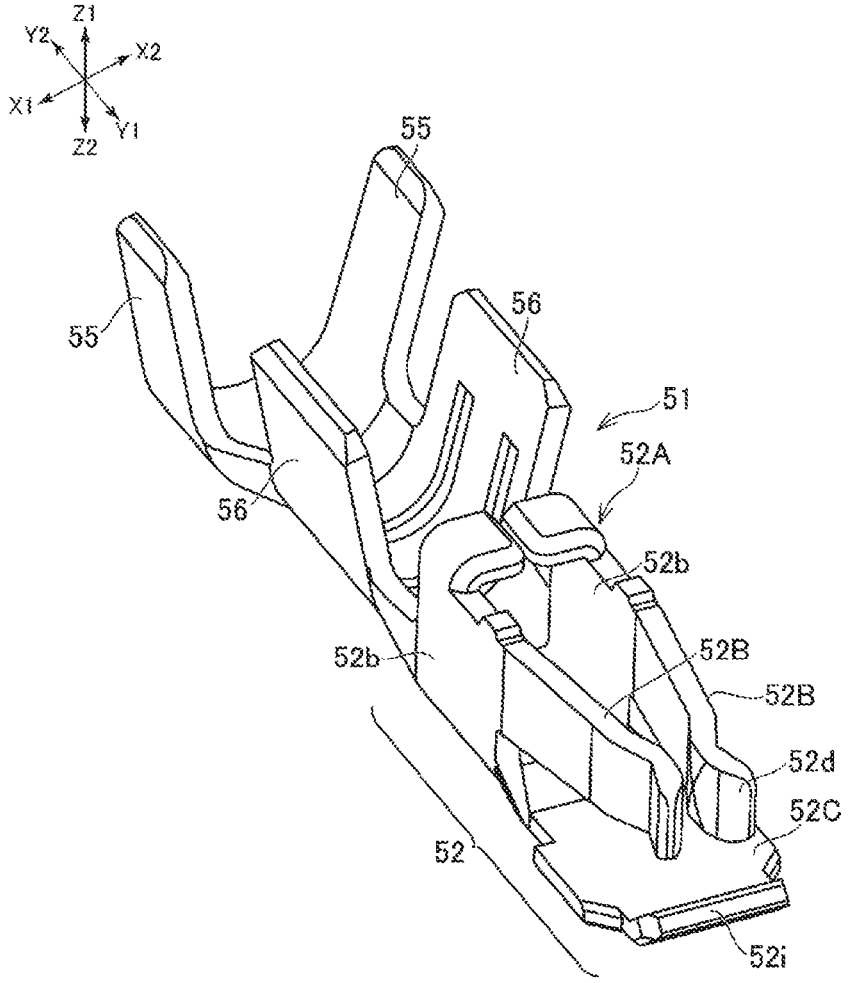
FIG. 7B is a perspective drawing of the receptacle terminal.

As shown in FIG. 7A and FIG. 7B, the receptacle terminals 51 can be provided at the back end thereof with a cable retention part 55 for retaining the outside (cover) of an electrical cable 91. For example, a plate shaped part can be rounded into a ring shape, configuring a cable retention part 55 for retaining the outside of an electrical cable 91. Furthermore, the receptacle terminal 51 can have a cable connecting part 56 at the front of the cable retention part 55 for retaining the conductor of the electrical cable 91 and establishing electrical connection with the conductor. For example, a plate shaped part can be rounded into a ring shape, configuring the cable connecting part 56 for retaining the conductor. The receptacle terminal 51 can have a main body part 52 in front of the cable connecting part 56.

As shown in FIG. 7A and FIG. 7B, the main body part 52 can have a base part 52A, a pair of elastic contact parts 52B extending to the front from the base part 52A, and an extension part 52C positioned above the pair of elastic contact parts 52B and extending along the elastic contact parts 52B.

In the example of receptacle terminal 51, the base part 52A has upper plate part 52*a*, and side plate parts 52*b* on the left and right. The side plate parts 52*b* are connected to the left and right edges of the upper plate part 52*a* and extend vertically. The two elastic contact parts 52B respectively extend from the side plate parts 52*b* on the left and right and mutually face each other in the left and right directions. The two elastic contact parts 52B have a plate spring shape that can elastically deform in the left and right directions, and can move closer together and farther apart. The extension part 52C extends to the front from the upper plate part 52*a* of the base part 52A parallel with the elastic contact parts 52B on the left and right. The structure of the receptacle terminal 51 is simply one example explained here. For example, the extension part 52C can be positioned under the elastic contact parts 52B.

Each of the elastic contact parts 52B extend diagonally from the base part 52A towards the center of the receptacle terminal 51. As shown in FIG. 6B, the elastic contact part 52B can have a contact 52*c* that is positioned closest to the center and contacts the side surface of the plug terminal 11. In addition, each of the elastic contact parts 52B can have guide parts 52*d*, extending diagonally from the contact 52*c* to the front, and diverging from the center of the receptacle terminal 51. When the connectors 10 and 50 engage, the end part (rear end) of the plug terminals 11 come into contact with the guide parts 52*d* and are guided into the receptacle terminal 51.

As shown in FIG. 7A, the main body part 52 can have an engaging part 52D that catches on the terminal retention hole 61 of the receptacle housing 60. The engaging part 52D restricts disengagement of the receptacle terminal 51 from the terminal retention hole 61. In the example of receptacle connector 50, the engaging part 52D protrudes upwards from the upper plate part 52*a* of the base part 52A. The engaging part 52D has an inclined surface 52*e*, extending diagonally upwards and backwards from the connecting part of the upper plate part 52*a*. The receptacle housing 60 has a vertically elastically deformable stopper part 62 above the terminal retention hole 61.

Figure 5A:
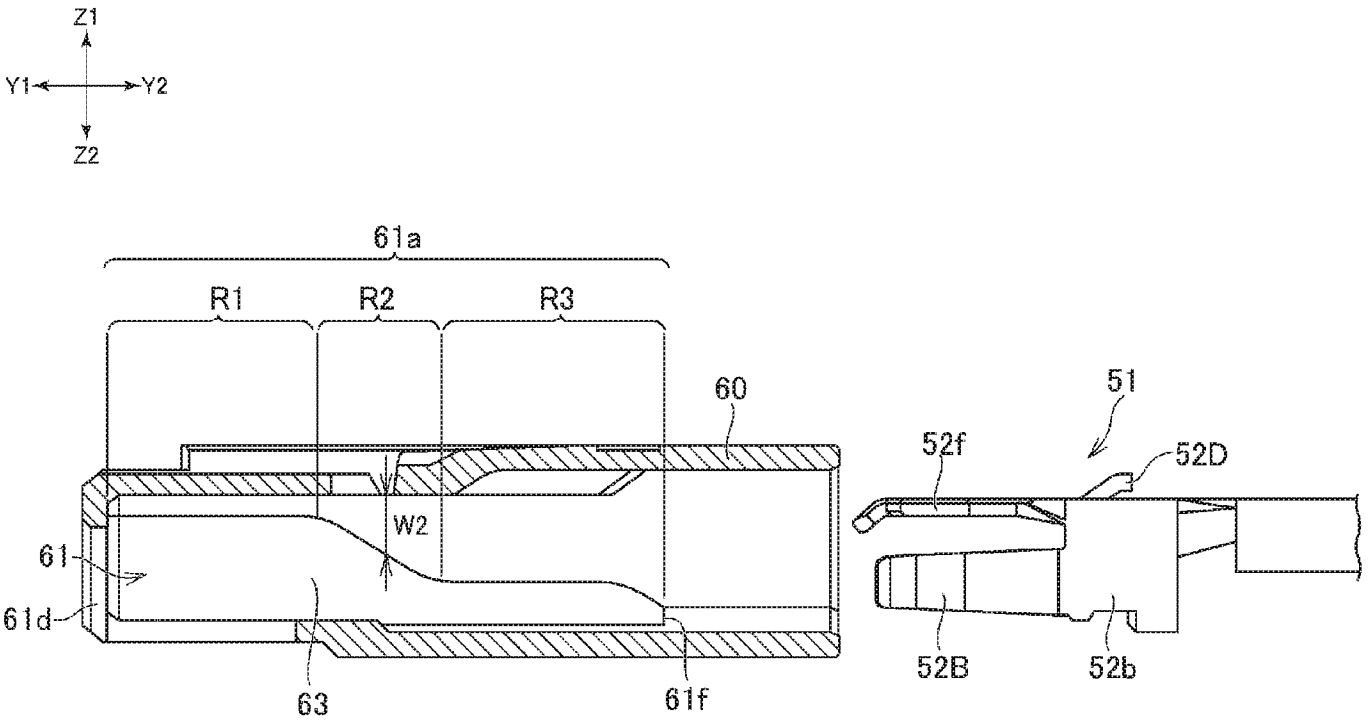
FIG. 5A is a diagram showing a receptacle terminal and a cross section of the receptacle housing.
Figure 5B:
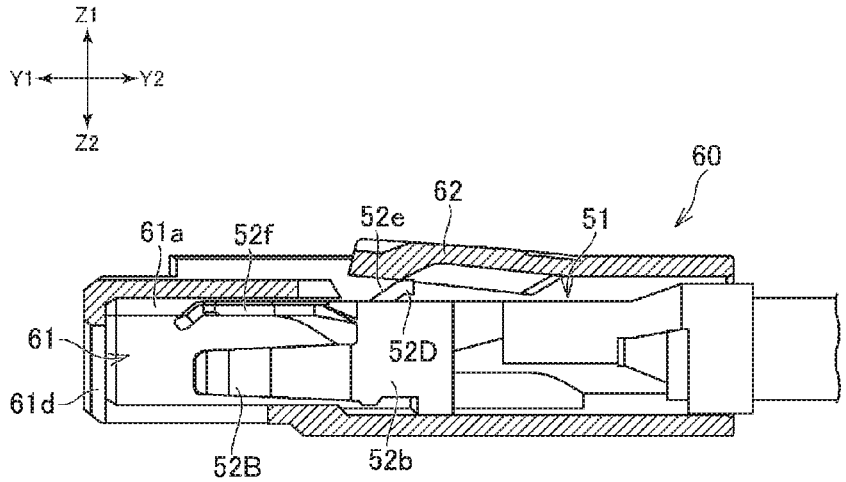
FIG. 5B is a diagram showing a receptacle terminal and a cross section of the receptacle housing.
Figure 5C:
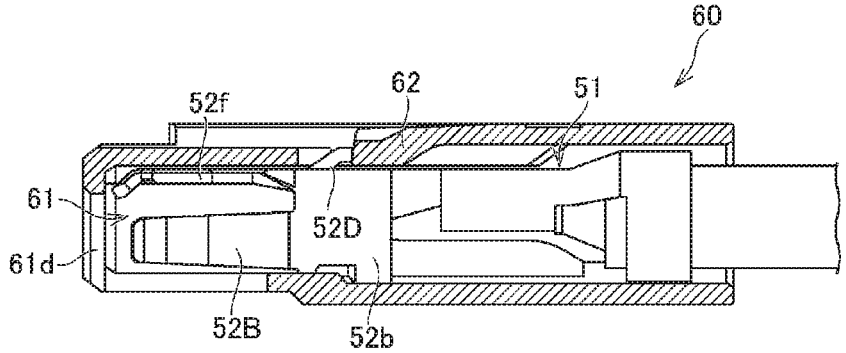
FIG. 5C is a diagram showing a receptacle terminal and a cross section of the receptacle housing.

As shown in FIG. 5B, in the process of engaging the receptacle terminal 51 into the terminal retention hole 61, the stopper part 62 is pushed by the inclined surface 52*e* of the engaging part 52D and elastically deforms upwards. As shown in FIG. 5C, when the receptacle terminal 51 is fully engaged in the terminal retention hole 61 of the receptacle housing 60, the engaging part 52D reaches to the front of the stopper part 62. Thus, rearward movement of the receptacle terminal 51, in other words disengagement of the receptacle terminal 51, is restricted.

The structure for restricting disengagement of the receptacle terminal 51 is just one example explained in the present specification. For example, the engaging part 52D could be formed from the extension part 52C extending from the upper plate part 52*a*, rather than from the upper plate part 52*a* of the base part 52A. In another example, the engaging part 52D can be a hole. In such a case, stopper part 62 of the receptacle housing 60 can be a part that engages with the hole that is the engaging part 52D.

As shown in FIG. 7A, a front-most part 52*i* of the extension part 52C can be inclined towards the elastic contact parts 52B (this inclined front-most part 52*i* is called the inclined part below). Based on the presence of this inclined part 52*i*, the distance between the elastic contact parts 52B and the extension part 52C is reduced, allowing for foreign materials to be prevented from entering into the space between the extension part 52C and the elastic contact parts 52B.

As shown in FIG. 7A, the receptacle terminal 51 can have a protruding guide part 52*f* that protrudes from the receptacle terminal 51 to the left and to the right. Regarding the example of the receptacle connector 50, the protruding guide part 52*f* is formed on the left and right edges of the extension part 52C. In other words, the receptacle terminal 51 has a protruding guide part 52*f* that projects to the left from the left edge of the extension part 52C and a protruding guide part 52*f* that projects towards the right from the right edge of the extension part 52C.

Figure 4:
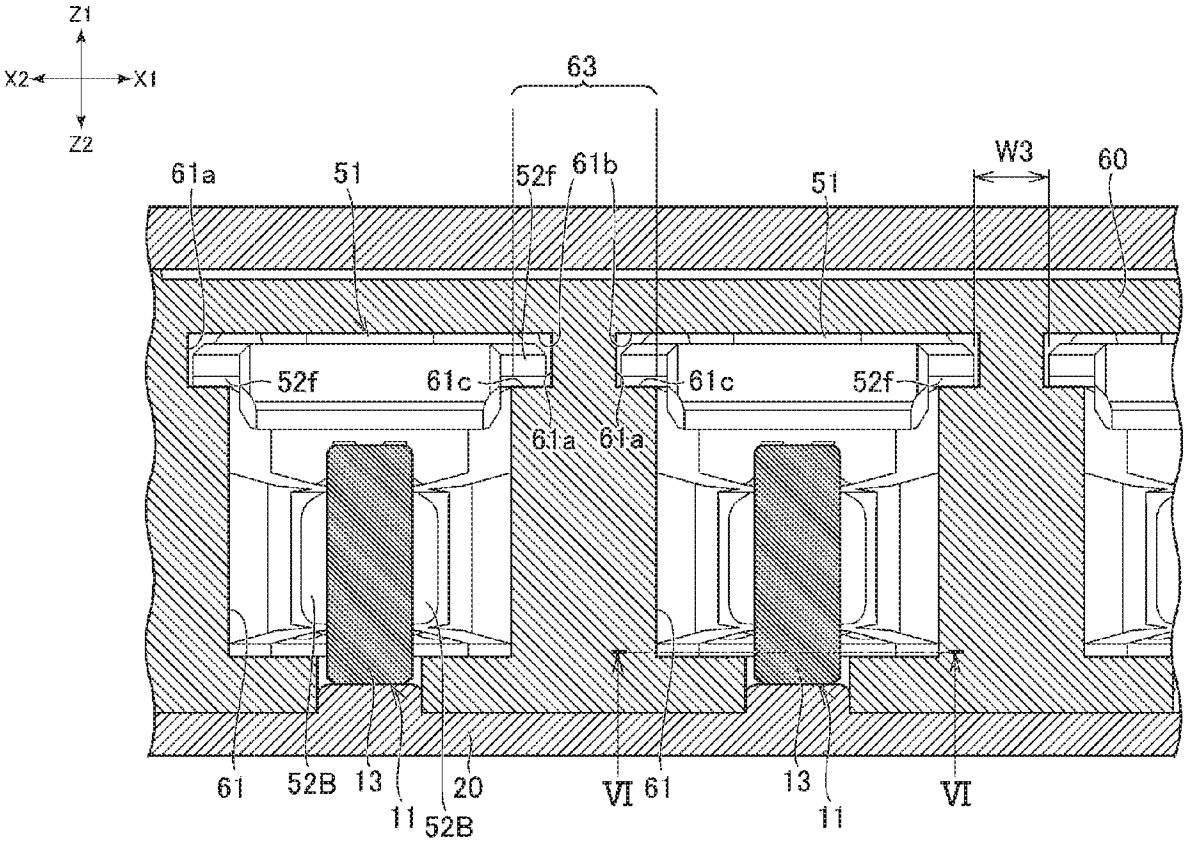
FIG. 4 is a cross-sectional view of the connector assembly taken along line IV-IV of FIG. 3.

As shown in FIG. 4 and FIG. 5A, a guide groove 61*a* that extends along the longitudinal direction can be formed on the interior of the terminal retention hole 61. Regarding the example of the receptacle connector 50, the guide groove 61*a* is formed on the left and right sides of the inner surface of the terminal retention hole 61. The receptacle housing 60 has a partition part 63 that partitions the two terminal retention holes 61 that are adjacent on the left and right, and the guide groove 61*a* is formed on the right side surface and left side surface of the partition part 63.

As shown in FIG. 4, when the receptacle terminal 51 is retained by the terminal retention hole 61, the protruding guide part 52*f* engages with this guide groove 61*a*. The guide groove 61*a* is formed along the longitudinal direction, allowing the protruding guide part 52*f* to slide in the longitudinal direction. As shown in FIG. 5A through FIG. 5C, the protruding guide part 52*f* slides along the guide groove 61*a* during the process of inserting the receptacle terminal 51 in the terminal retention hole 61. The position and orientation of the receptacle terminal 51 are thereby optimized.

As shown in FIG. 4, the guide groove 61*a* has an upper surface 61*b* and bottom surface 61*c*. The protruding guide part 52*f* is positioned between these two surfaces 61*b* and 61*c*. As shown in FIG. 5A, the guide groove 61*a* can have three areas. In other words, the guide groove 61*a* can have a middle region R2, a front side region R1 provided to the front of the middle region R2, and a rear side region R3 provided behind the middle region R2. Regarding the middle region R2, the bottom surface 61*c* of the guide groove 61*a* is formed diagonally frontward and upward, such that a distance W2 between the upper surface 61*b* and the bottom surface 61*c* gradually decreases going frontward. Regarding the front side region R1, the distance W2 between the upper surface 61*b* and the bottom surface 61*c* is slightly larger when compared to the thickness of the protruding guide parts 52*f*. In addition, regarding the front side region R1, the distance W2 is set such that the protruding guide parts 52*f* can be inserted between the upper surface 61*b* and the bottom surface 61*c*, in addition to determining the position of the protruding guide parts 52*f* in the longitudinal direction. Regarding the rear side region R3, the distance W2 between the upper surface 61*b* and the bottom surface 61*c* is somewhat larger than the protruding guide part 52*f*. In the case that the position of the receptacle terminal 51 is vertically offset relative to the terminal retention hole 61 in the process of fitting the receptacle terminal 51 into the terminal retention hole 61, the receptacle terminal 51 is guided to the normal position by the bottom surface 61*c* of the guide groove 61*a*.

Furthermore, the structure of the guide groove 61*a* is not limited to the example of the receptacle housing 60. For example, the guide groove 61*a* does not need to have a rear side region R3. In addition, the guide groove 61*a* does not need to have a middle region R2 and a rear side region R3.

As shown in FIG. 5A, the terminal retention hole 61 has a stopper surface 61*f* on the inner surface thereof. The stopper surface 61*f* collides with the protruding guide part 52*f* if the orientation of the receptacle terminal 51 is inverted in the vertical direction in the process of inserting the receptacle terminal 51 in the terminal retention hole 61. There can be a stopper surface 61*f* behind the guide groove 61*a* on the inner surface of the terminal retention hole 61. The stopper surface 61*f* is, for example, a perpendicular plane connected to the tail end of the bottom surface 61*c* of the guide groove 61*a* that faces the rear. If the orientation of the receptacle terminal 51 is inverted in the vertical direction, or in other words, if the extension part 52C of the receptacle terminal 51 is positioned below the elastic contact parts 52B, the protruding guide part 52*f* collides with the stopper surface 61*f*, preventing the receptacle terminal 51 from being inserted into the terminal retention hole 61.

Furthermore, as shown in FIG. 6B, as seen from the bottom surface of the receptacle terminal 51, protruding guide parts 52*f* can be positioned to the outside in the left and right directions of the left and right elastic contact parts 52B. The protruding guide parts 52*f* can be positioned on the outermost side of the main body part 52. In other words, the protruding guide part 52*f* on the right side can be positioned further to the right than the elastic contact parts 52B on the right side and the side plate part 52*b* on the right side of the base part 52A. The protruding guide part 52*f* on the left side can be positioned further to the left than the elastic contact parts 52B on the left side and the side plate part 52*b* on the left side of the base part 52A. Thus, the protruding guide part 52*f* fits into the guide groove 61*a*. In addition, in the example for the receptacle terminal 51, the protruding guide part 52*f* is formed more towards the rear than the inclined part 52*i* of the extension part 52C.

As shown in FIG. 6B, a front end 52*g* of the protruding guide part 52*f* can be inclined towards the rear or to the outer left and right sides. By doing so, even if the position of the receptacle terminal 51 is offset in the horizontal direction in the process of inserting the receptacle terminal 51 into the terminal retention hole 61 of the receptacle housing 60, the front end 52*g* will hit the edge of the terminal retention hole 61 and the receptacle terminal 51 will be guided to the correct position.

The position of the protruding guide part 52*f* is not limited to the example of the receptacle terminal 51. For example, the protruding guide part 52*f* can be formed on the base part 52A of the main body part 52 rather than on the extension part 52C. In such a case, the protruding guide part 52*f* can be formed on the upper part of the base part 52A or formed on the lower part of the base part 52A. The position of the guide groove 61*a* can be changed in accordance with the position of the protruding guide part 52*f* In other further examples, there can be a protruding guide part 52*f* on just one of the right or left sides of the receptacle terminals 51.

Figure 8A:
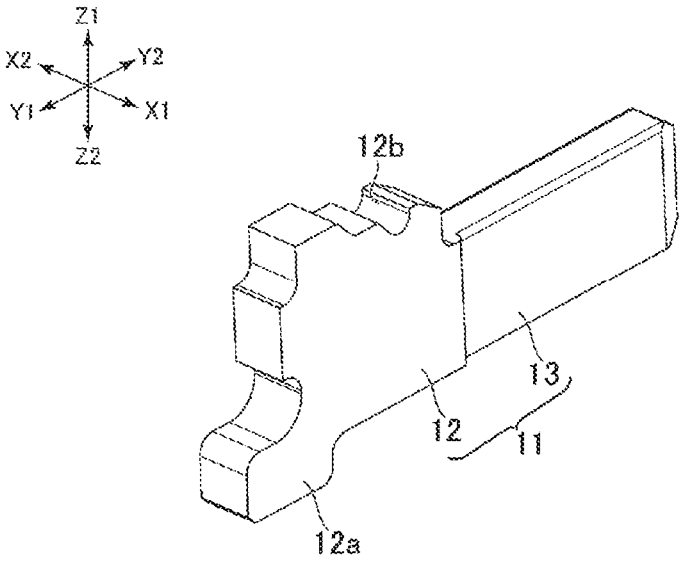
FIG. 8A is a perspective drawing of the plug terminal.
Figure 8B:
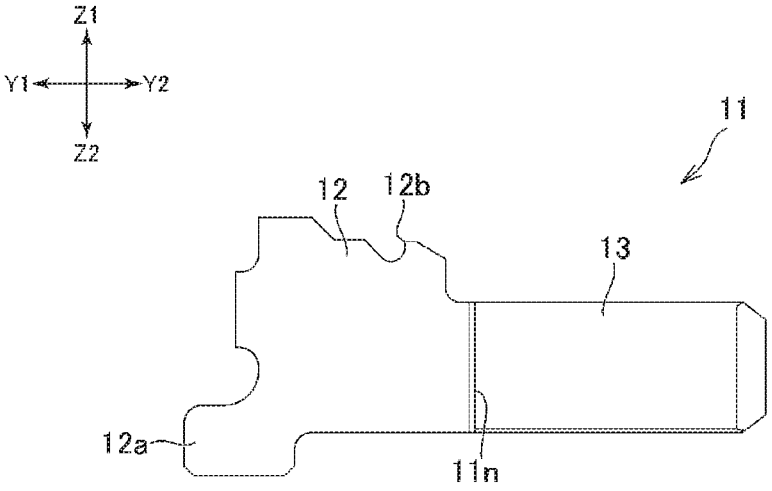
FIG. 8B is a perspective drawing of the plug terminal.

As illustrated in FIG. 8A and FIG. 8B, each of the plug terminals 11 has a base part 12 and a contact part 13 that extend from the base part 12 towards the rear side (receptacle connector 50 side). The base part 12 is the portion that is retained in the interior of the terminal retention holes 21. For example, a hook part 12*b* that catches on the inner surface of the terminal retention holes 21 is formed on the top surface of the base part 12. The position of the hook part 12*b* is not restricted to the example of the plug terminals 11. For example, hook part 12*b* can be formed on the bottom surface of the base part 12.

Figure 6A:
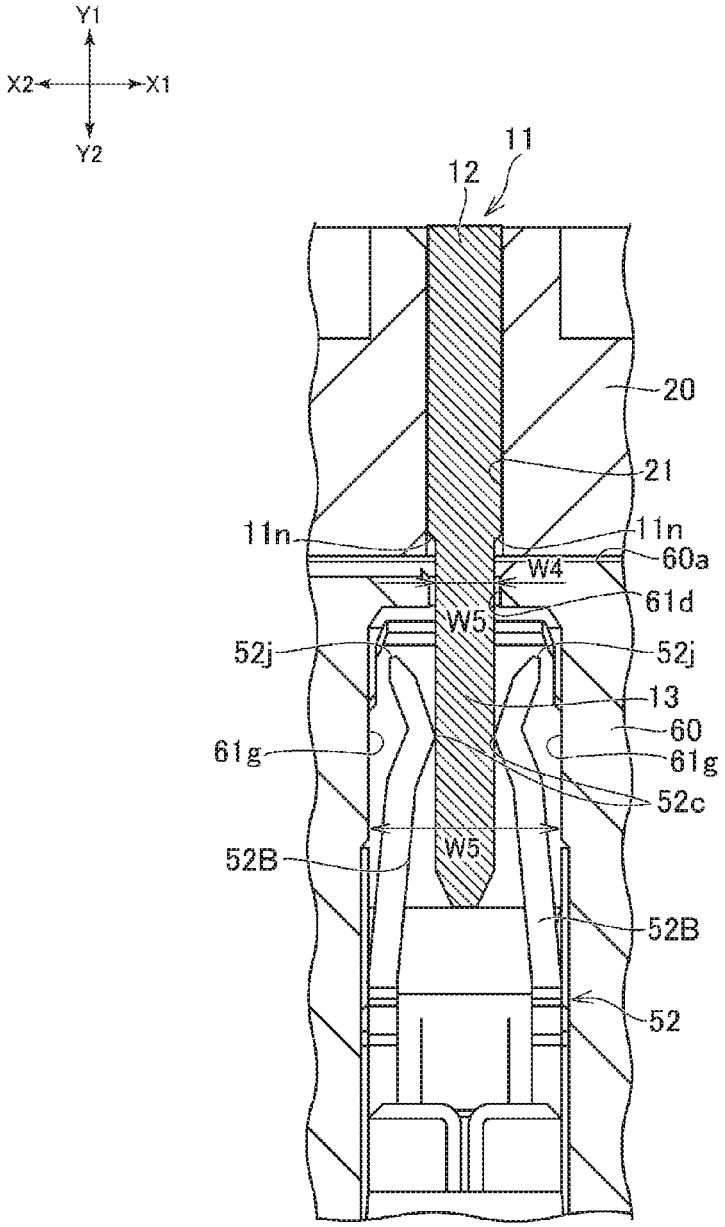
FIG. 6A is a cross-sectional view of the connector assembly taken along line VI-VI of FIG. 4.
Figure 6B:
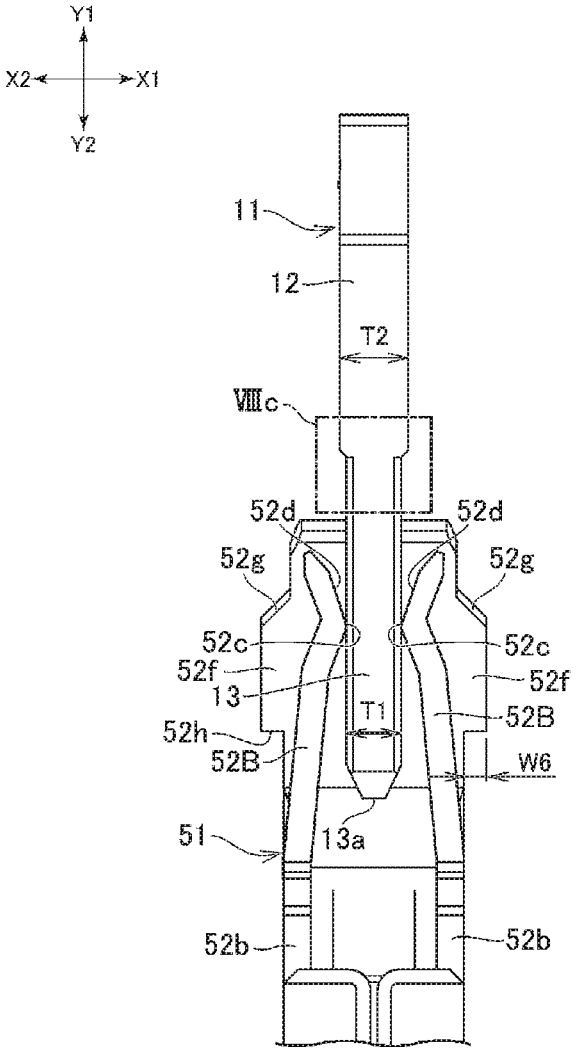
FIG. 6B is a diagram showing the positional relationship of the receptacle terminal and plug terminal shown in FIG. 6A

As shown in FIG. 6A, when the connectors 10 and 50 are engaged, the contact part 13 is engaged with the receptacle connector 50 and contacts the receptacle terminal 51. More specifically, the contact part 13 is inserted into the two elastic contact parts 52B and comes into contact with the contacts 52*c* that are provided on the internal side surfaces. The contact part 13 expands the elastic contact parts 52B outwards in the left and right directions and is inserted into the interior thereof. The elastic contact parts 52B come into contact with the side surface of the contact part 13 based on this elastic force. Thus, an electrical connection is established between the plug terminals 11 and the receptacle terminal 51.

When a protruding guide part 52*f* is formed on the receptacle terminal 51, a distance W3 between the protruding guide parts 52*f* of adjacent receptacle terminals 51 becomes smaller (see FIG. 4). As a result, the width of the partition part 63 of the receptacle housing 60 becomes smaller in the guide groove 61*a* part and molding the receptacle housing 60 can possibly become difficult. Inversely, if the distance W3 between protruding guide parts 52*f* of adjacent receptacle terminal 51 is maintained and a protruding guide part 52*f* is molded onto the receptacle terminal 51, the interval (pitch) between receptacle terminals 51 increases.

Therefore, in the example for the connector assembly 1, as shown in FIG. 6B and FIG. 8, a thickness T1 in the horizontal direction of the contact part 13 of the plug terminals 11 (see FIG. 6B) is smaller than a thickness T2 of the base part 12 of the plug terminals 11 (see FIG. 6B). Thus, reduction of the interval between the left and right elastic contact parts 52B becomes possible. As a result, protruding guide parts 52*f* can be formed on the receptacle terminal 51 without increasing the width of the main body part 52 of the receptacle terminal 51 in the horizontal direction (in other words, without decreasing the distance W3 of the width between the protruding guide parts 52*f* of the adjacent receptacle terminals 51). In addition, regarding conventional structures, ensuring sufficient width of the bottom surface 61*c* in the horizontal direction such that the protruding guide part 52*f* sufficiently supports the bottom surface 61*c* of the guide groove 61*a* results in a need to reduce a width W5 of the terminal retention hole 61 in the horizontal direction (see FIG. 6A). In such a case, the end parts 52*j* (see FIG. 6A) of the elastic contact parts 52B spread out and come into contact with a side surface 61*g* (see FIG. 6A) inside the terminal retention hole 61 when the plug terminal 11 and the receptacle terminal 51 are engaged. Ensuring a sufficient amount of elastic displacement of the elastic contact parts 52B required for contact pressure with the plug terminal 11 (in other words, for the inclination of the elastic contact parts 52B) may also become difficult. On the other hand, a structure of the connector assembly 1 where the thickness T1 of the contact part 13 in the horizontal direction is smaller than a thickness T2 will ensure a sufficient width of the bottom surface 61*c* in the horizontal direction, and will ensure the amount of elastic displacement of the elastic contact parts 52B needed for contact pressure with the plug terminal 11, and a collision between the end part 52*j* and the side surface 61*g* can thereby be prevented.

In addition, rather than the entire thickness of the plug terminals 11 being increased, the thickness T2 of the base part 12 is increased larger than the thickness T1 of the contact part 13, which reduces deterioration in electrical conductivity. Such plug terminals 11 can be formed, for example, by performing punch processing or compression processing on a metal plate.

Figure 8C:
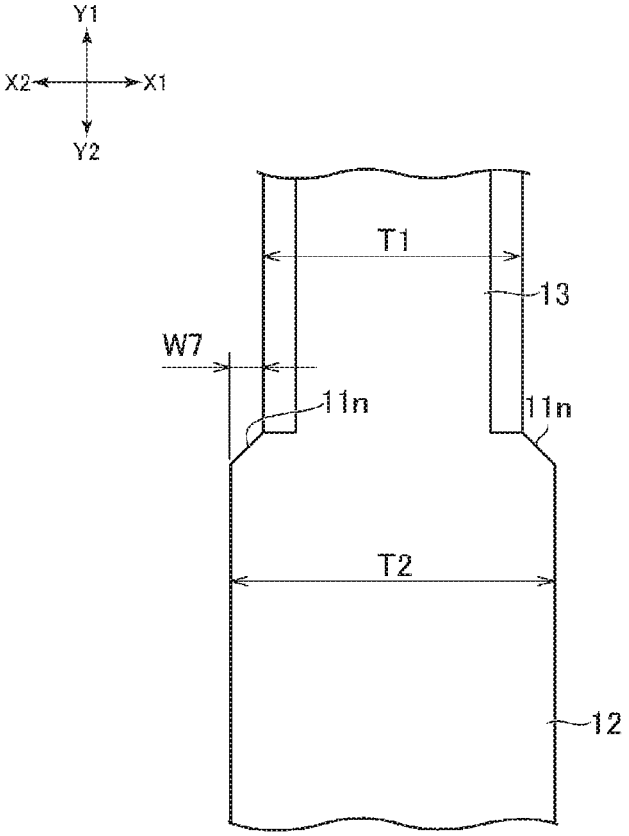
FIG. 8C is an enlarged view of the area shown in VIIIc of FIG. 6B.

As shown in FIG. 8B and FIG. 8C, a difference in level 11*n* that extends in the vertical direction can be formed on both the left and right side surfaces of the plug terminals 11. In the example for the plug connector 10, the difference in level 11*n* continues from the upper surface to the bottom surface of the plug terminals 11. The entire part behind the difference in level 11*n* (contact part 13) is thinner than the thickness T2 of the base part 12. The thickness of the contact part 13 is uniform from the difference in level 11*n* to the tip 13*a* of the contact part 13 (rear end of the plug terminal 11).

As described above, the base part 12 has a mounting part 12*a* (see FIG. 8A) for mounting on the circuit board, exposed on the terminal retention holes 21 of the plug housing 20. The thickness of the mounting part 12*a* is larger than the thickness T1 of the contact part 13. Electrical conductivity can thereby be ensured at the contact part between the circuit board and the plug terminals 11.

In the example of plug connector 10, an entire part in front of the difference in level 11*n* (base part 12) is thicker than the thickness T1 of the contact part 13. Thus, deterioration of electrical conductivity can be reduced in comparison to a structure where the thickness of the mounting part 12*a* is thicker than the contact part 13, for example.

Furthermore, the structure of the plug terminals 11 is not limited to the example of plug connector 10. For example, a part of the contact part 13 itself can have a smaller thickness T1 than the thickness T2 of the base part 12. For example, only the part of the plug terminal 11 that is in contact with the contact 52*c* (center part in vertical direction) during and after insertion into the receptacle terminal 51 needs to have a thickness T1 smaller than that of base part 12. Furthermore, other parts of the contact part 13 can have the same thickness T2 as the base part 12.

As shown in FIG. 6B, the protruding guide part 52*f* has a front end 52*g* and a rear end 52*h*. The contact part 13 is positioned between the left and right protruding guide parts 52*f* in a state where the connectors 10 and 50 are engaged. In further detail, the tip 13*a* of the contact part 13 is positioned more towards the back than the rear end 52*h* of the protruding guide part 52*f*.

The positional relationship of the protruding guide part 52*f* and the contact part 13 is not restricted to the example of connector assembly 1. For example, the rear end 52*h* of the protruding guide part 52*f* can be positioned near the base part 52A of the main body part 52. Here, the tip 13*a* of the contact part 13 can be positioned more forward than the rear end 52*h* of the protruding guide part 52*f* in a state where the connectors 10 and 50 are engaged.

As shown in FIG. 6A, in a state where the connectors 10 and 50 are engaged, the base part 12 of the plug terminal 11 is separated to the front from the elastic contact parts 52B and positioned more forward than a front surface 60*a* of the receptacle housing 60. The receptacle housing 60 has a retaining hole entrance 61*d* connected to the terminal retention hole 61 on the front surface 60*a*. Width W4 of the retaining hole entrance 61*d* is smaller than the width W5, which is the area where the main body part 52 of the receptacle terminal 51 is arranged in the terminal retention hole 61.

The contact part 13 is inserted in the terminal retention hole 61 through this retaining hole entrance 61*d*. The contact part 13 is positioned in the position of the retaining hole entrance 61*d* in a state where the connectors 10 and 50 are engaged. In other words, the contact part 13 with a reduced thickness T1 is positioned on the inside of the inner edge of the retaining hole entrance 61*d*, and not at the base part 12 of the plug terminal 11. Thus, a width W4 of the retaining hole entrance 61*d* can be reduced in comparison to a structure where the base part 12 is positioned inside the inner edge of the retaining hole entrance 61*d*. As a result, the elastic contact parts 52B of the receptacle terminal 51 are prevented from being largely exposed from the interior of the retaining hole entrance 61*d* when the two connectors 10 and 50 are not engaged.

In the example for the plug connector 10, the thickness T1 of the contact part 13 is uniform from the top surface to the bottom surface of the contact part 13. Thus, the width W4 of the retaining hole entrance 61*d* can be reduced uniformly in the vertical direction.

As described above, there are difference in levels 11*n* on the side surfaces of the plug terminal 11. A dimension W7 of such a difference in level 11*n* (see FIG. 8*c*) in the horizontal direction can be smaller than width W6 of the protruding guide part 52*f* (see FIG. 6B) in the horizontal direction. In other words, the differences in the thickness T2 of the base part 12 of the plug terminals 11 and the thickness T1 of the contact part 13 can be smaller than the width of the left and right protruding guide parts 52*f* (W6×2). According to such a structure, the thickness T1 of the contact part 13 is enlarged in comparison with a structure that reduces the thickness of the contact part 13 by the same amount as the width W6 of the protruding guide part 52*f*. As a result, deterioration of electrical conductivity can be reduced.

Furthermore, the thickness T1 and T2 of the plug terminal 11 and the width W6 of the protruding guide part 52*f* are not limited to the example for the connector assembly 1. Unlike the example for the connector assembly 1, dimension W7 of the difference in level 11*n* in the horizontal direction (see FIG. 8C) can be the same as width W6 of the protruding guide part 52*f* in the horizontal direction (see FIG. 6B), or it can also be bigger than the width W6.

In addition, in the example for the connector assembly 1, as shown in FIG. 6B, the thickness T1 and T2 of the plug terminals 11 are larger than the thickness of the elastic contact parts 52B. In other words, the thickness of the metal plate that makes up the plug terminals 11 is larger than the thickness of the metal plate that makes up the receptacle terminal 51. In such a manner, a part with a relatively large thickness (the base part 12) and a part with a relatively thin thickness (the contact part 13) are formed on the one of the two terminals 11 and 51 that is formed with thick material (the plug terminal 11).

In addition, as shown in FIG. 6B, the width W6 of the protruding guide part 52*f* is smaller than the thickness T2 of the base part 12 of the plug terminal 11. In addition, the width W6 of the protruding guide part 52*f* is smaller than the thickness T1 of the contact part 13 of the plug terminals 11. As the width W6 of the protruding guide part 52*f* is comparatively small in such a manner, it becomes easier to ensure a distance W3 between the protruding guide parts 52*f* of the adjacent receptacle terminals 51 (see FIG. 4), in comparison with a structure, for example, where the width W6 of the protruding guide part 52*f* is larger than the thickness T1 of the contact part 13 of the plug terminals 11.

In addition, in the example for the connector assembly 1, the distance W3 between the protruding guide parts 52*f* of the adjacent receptacle terminals 51 (see FIG. 4) is smaller than the thickness of the plug terminals 11 (more specifically, the thickness T2 of the base part 12 and the thickness T1 of the contact part 13).

As has been described above, with the connector assembly 1, each of the receptacle terminals 51 has a protruding guide part 52*f* and the terminal retention holes 61 of the receptacle housing 60 have guide grooves 61*a* on the inner surfaces thereof for the protruding guide parts 52*f* to engage with and permit sliding of the protruding guide parts 52*f*. Each of the plug terminals 11 has a base part 12 and a contact part 13 that comes into contact with the receptacle terminal 51. The thickness T1 of the plug terminal 11 contact part 13 in the horizontal direction is smaller than the thickness T2 of the plug terminal 11 base part 12 in the horizontal direction.

The connector assembly proposed in the present disclosure is not restricted to the connector assembly 1 thus far described.

For example, in the connector assembly 1 example, the receptacle terminal 51 has two opposing elastic contact parts 52B. However, the structure of the receptacle terminal 51 is not necessarily restricted thereto. For example, the receptacle terminal 51 can have only one plate spring shaped part. Furthermore, the plug terminal 11 can come in to contact with the side surface of this plate spring shaped part.

The invention claimed is:

1. A connector assembly, comprising:

a receptacle connector with a plurality of receptacle terminals lined up in a first direction and a receptacle housing with a plurality of receptacle terminal retention holes for retaining the plurality of receptacle terminals; and a plug connector with a plurality of plug terminals lined up in the first direction and a plug housing with a plurality of plug terminal retention holes for retaining the plurality of plug terminals, the plug connector configured to engage with the receptacle connector in a second direction orthogonal to the first direction; wherein:

each receptacle terminal having a main body part, the main body part having a base part, first and second elastic contact parts, and a protruding guide part, the first and second elastic contact parts extending in the second direction from the base part, the protruding guide part protruding in the first direction, the protruding guide part not protruding from either of the first and second elastic contact parts;

each receptacle terminal retention hole having a guide groove on an inner surface thereof, each guide groove configured to engage with a respective one of the protruding guide parts and permit sliding of the protruding guide part in the second direction;

each plug terminal is configured to engage with the receptacle connector and contact the first and second elastic contact parts of a respective one of the receptacle terminals.

2. The connector assembly according to claim 1, wherein:

the base part of each plug terminal is exposed from the plug terminal retention hole and has a mounting part for mounting to a circuit board.

3. The connector assembly according to claim 1, wherein:

the base part of each plug terminal comprises a part retained inside the plug terminal retention hole.

4. The connector assembly according to claim 1, wherein a width of the protruding guide part in the first direction is smaller than a thickness of the contact part of each plug terminal.

5. The connector assembly according to claim 1, wherein a distance between the protruding guide parts of two adjacent receptacle terminals in the first direction is smaller than a thickness of the contact part of each plug terminal.

6. The connector assembly according to claim 1, wherein:

the receptacle housing has retention hole entrances respectively connected to the plurality of receptacle terminal retention holes for entry of the plug terminals; and when the receptacle connector and plug connector are engaged, the contact part of the plug terminals is positioned inside an inner edge of the retention hole entrances.

7. The connector assembly according to claim 1, wherein:

the receptacle terminals have protruding guide parts on two respective edges positioned on mutually opposite sides in the second direction; and when the plug connector and receptacle connector are engaged, the contact parts of the plug terminals are positioned between the protruding guide parts formed on the two edges.

8. The connector assembly according to claim 1, wherein the main body part of each receptacle terminal has an extension part which extends in the second direction from the base part.

9. The connector assembly according to claim 8, wherein the extension part of each receptacle terminal extends along the first and second elastic contact parts and is separated from the first and second elastic contact parts in a third direction, the third direction being orthogonal to each of the first and second directions.

10. The connector assembly according to claim 9, wherein the protruding part protrudes from the extension part in the first direction.

11. The connector assembly according to claim 8, wherein the protruding part protrudes from the extension part in the first direction.

12. A receptacle connector assembly, comprising:

a receptacle connector with a plurality of receptacle terminals lined up in a first direction and a receptacle housing with a plurality of receptacle terminal retention holes for retaining the plurality of receptacle terminals; and each receptacle terminal having a main body part, the main body part having a base part, first and second elastic parts, and a protruding guide part, the first and second elastic contact parts extending in the second direction from the base part, the protruding guide part protruding in the first direction, the protruding guide part not protruding from either of the first and second elastic contact parts;

each receptacle terminal retention hole having a guide groove on an inner surface thereof, each guide groove configured to engage with a respective one of the protruding guide parts and permit sliding of the protruding guide part in the second direction.

* * * * *